United States Patent [19]

Negrini et al.

[11] Patent Number: 4,954,112

[45] Date of Patent: Sep. 4, 1990

[54] FLIPPER FOR FLIPPER SWIMMING

[76] Inventors: Giovanni Negrini, Via Carlo Porta, 13; Roberto Chiola, Via Talamone, 8, both of I 27029 Vigevano, Italy

[21] Appl. No.: 330,785

[22] Filed: Mar. 30, 1989

[51] Int. Cl.[5] ..... A63B 31/10

[52] U.S. Cl. ..... 441/64; 441/61

[58] Field of Search ..... 441/61-64; 440/15; D21/238, 239

[56] References Cited

U.S. PATENT DOCUMENTS 3,922,741 12/1975 Semeia ..... 441/64

4,738,645 4/1988 Garofalo ..... 441/64

FOREIGN PATENT DOCUMENTS 2329307 5/1977 France ..... 441/61

*Primary Examiner*—Joseph F. Peters, Jr.
*Assistant Examiner*—Edwin L. Swinehart
*Attorney, Agent, or Firm*—Stevens, Davis, Miller & Mosher

[57] ABSTRACT

A flipper for flipper swimming having a varying thickness blade of resin sheets of varying length stratified sheets interposed between longer resin sheets and a natural rubber shoe hot pressed to the blade.

2 Claims, 1 Drawing Sheet

FIG.1
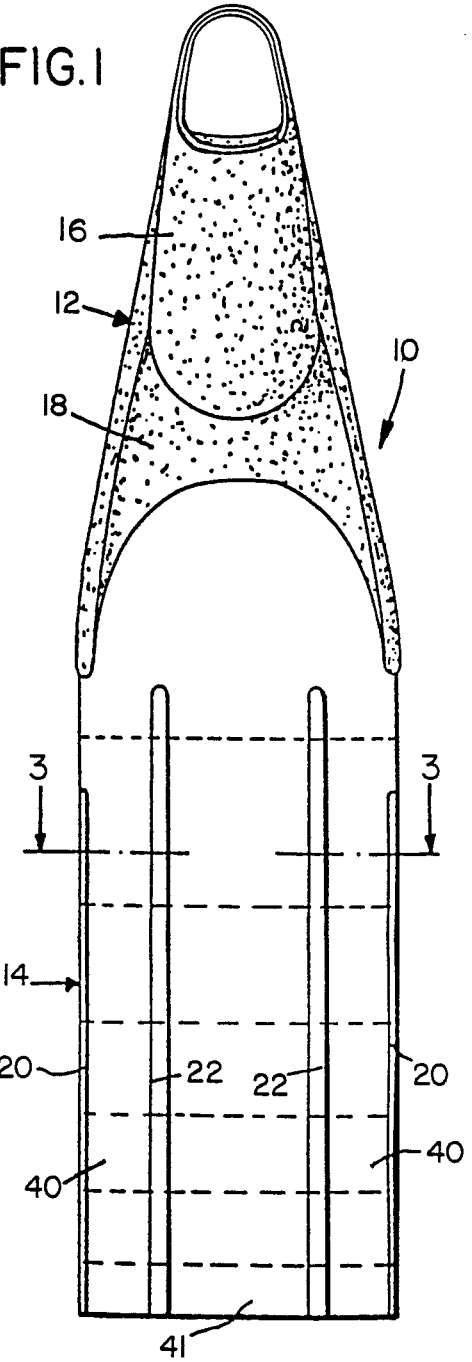
FIG.2
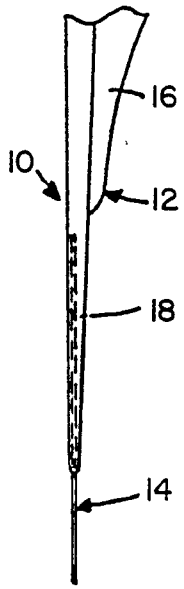
FIG.3
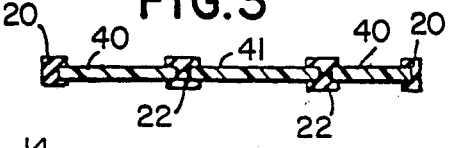
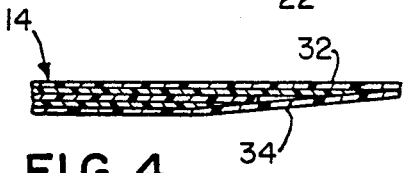
FIG.4

FLIPPER FOR FLIPPER SWIMMING

BACKGROUND OF THE INVENTION

The present invention relates to a flipper for flipper swimming comprising a shoe and a blade.

Flippers are known which are formed with a shoe and made out of rubber to which, by means of glue or screws, a plastic blade is fixed. The blade is of varying thickness. More precisely, a greater thickness is in proximity to the shoe and a laser thickness is at the free end of said blade. This reduction in thickness at the free end of the blade makes for stronger pushing power. This type of flipper has the drawback of being heavy, difficult to manufacture and thus expensive, not very resistant to separation of the shoe and blade due to lack of perfect bonding between rubber and plastic and not very resistant to blows to which the flippers are subject during the turning phase in the swimming pool. Moreover, the response of the blade both in the positive phase and in the negative phase of movement is not made the most of because the thickness variations cause different resistances in the two phases. Since these flippers are not mass-produced, when the swimmer has to exchange broken flippers for a new pair, the swimmer may notice different characteristics and thus the swimmer's performance may vary considerably due to the variation in the push force.

It is an object of the present invention to overcome the above-described drawbacks.

SUMMARY OF THE INVENTION

The technical problem to be solved was to develop a lightweight, resistant flipper which would give stronger push power and very remarkable stability.

The solution to the technical problem was forming the blade from resin sheets of varying length interposed between longer sheets of said resin.

BRIEF DESCRIPTION OF THE DRAWINGS

Further characteristics and advantages will stand out more clearly from the description given below and from the accompanying drawing, in which:

FIG. 1 is a top plan view of the flipper of the present invention;

FIG. 2 is a side view of the flipper of FIG. 1;

FIG. 3 is a section view taken along lines 3—3 of FIG. 1; and

FIG. 4 shows another detail of the flipper of FIG. 1.

DESCRIPTION OF THE PREFERRED EMBODIMENT

With reference to FIG. 1, flipper 10 is formed by a natural rubber shoe 12 and by a resin blade 14. The shoe 12 is formed with a foot pocket 16 on one end which fits snugly on the swimmer's foot, and by a portion 18 which is hot-pressed, onto the blade 14 to form a union of the shoe 12 and blade 14 into a unitary piece which withstands better the collision against the edges of the swimming pool during the turning phase and the push force imposed by the swimmer.

The blade 14 presents first lateral rubber inserts 20 (FIGS. 1 and 3) and second inserts 22 parallel to the first inserts and disposed longitudinally along the length of the blade 14 to create two outside section 40 and a central section 41. Blade 14 helps to channel the water, i.e., if the blade does not enter the water in a perfectly flat condition. The blade 14 may, however, glide transversely with respect to the displacement direction of the swimmer, causing a considerable reduction in the push force except for inserts 20 and 22. With the inserts 20 and 22 the blade 14 warps in such a way as to be always kept parallel to the displacement direction of the swimmer, thus creating a greater push force. The blade 14 is formed (FIG. 4) from resin sheets of varying lengths interposed between upper resin sheet 32 and lower resin sheet 34. This structure permits obtaining a blade with different hardnesses and thus permits the swimmer to make the most of the blade both in the positive phase and the negative phase.

I claim:

1. A swimming flipper comprising a shoe and a blade, said blade being formed from resin sheets of varying lengths interposed between resin sheets of longer length thereby forming a blade of stratified thickness, and said blade having rubber inserts longitudinally disposed along the length of said blade, said inserts being hot-pressed with said blade.

2. The flipper according to claim 1, wherein said shoe is made of natural rubber and is hot-pressed with said blade.

* * * * *